US008550851B2

(12) United States Patent
Takemoto

(10) Patent No.: US 8,550,851 B2
(45) Date of Patent: Oct. 8, 2013

(54) ELECTRONIC ELEMENT-INCORPORATING CONNECTOR

(75) Inventor: Masakazu Takemoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 149 days.

(21) Appl. No.: 13/184,929

(22) Filed: Jul. 18, 2011

(65) Prior Publication Data

US 2012/0052730 A1 Mar. 1, 2012

(30) Foreign Application Priority Data

Aug. 24, 2010 (JP) ..... 2010-187329

(51) Int. Cl.
*H01R 13/66* (2006.01)

(52) U.S. Cl.
USPC ..... 439/620.21

(58) Field of Classification Search
USPC ..... 439/620.21, 270, 95, 555–556
See application file for complete search history.

(56) References Cited

U.S. PATENT DOCUMENTS

| | | | | |
|---|---|---|---|---|
| 7,258,576 | B2 * | 8/2007 | Ohnishi | 439/620.01 |
| 7,833,061 | B2 * | 11/2010 | Hori et al. | 439/620.21 |
| 7,959,456 | B2 * | 6/2011 | Nagashima | 439/499 |
| 8,066,531 | B2 * | 11/2011 | Kanatsu | 439/620.22 |
| 8,317,538 | B2 * | 11/2012 | Carle et al. | 439/548 |
| 2009/0023341 | A1 * | 1/2009 | Craig | 439/620.21 |
| 2011/0237131 | A1 * | 9/2011 | Fields et al. | 439/620.21 |

FOREIGN PATENT DOCUMENTS

JP 10-229151 8/1998

* cited by examiner

*Primary Examiner* — Jean F Duverne
(74) *Attorney, Agent, or Firm* — Gerald E. Hespos; Michael J. Porco; Matthew T. Hespos

(57) ABSTRACT

An electronic element-incorporating connector (10) has two bus bars (30) mounted side-by-side in a housing (40) and an electronic element (20) with lead wires (22) at both ends of an electronic element body (21). The lead wires (22) are welded to element connection parts (31) of the bus bars (30). The element connection parts (31) project from an upper surface of the housing (40). Each lead wire (22) has a straight part (23) adjacent the resistance element body (21) and a bend (25) between the straight part (23) and the element connection part (31).

6 Claims, 17 Drawing Sheets

ELECTRONIC ELEMENT-INCORPORATING CONNECTOR

BACKGROUND OF THE INVENTION

1. Field of the Invention

The invention relates to a connector incorporating an electronic element.

2. Description of the Related Art

Japanese Patent Unexamined Publication No. 10-229151 discloses a connector to be used for an $O_2$ sensor of an engine mounted on a car and incorporates an electronic element, namely a resistance element. The resistance element is spanned between two bus bars and soldered thereto, and the periphery of the resistance element is resin-molded.

The above-described connector may require the kind of the resistance element to be altered according to the kind of the $O_2$ sensor. A connector has been developed in recent years with a resistance element that has a pair of lead wires provided at both ends of a resistance element body. Bus bars have element connection parts connected to the lead wires respectively and equipment connection parts connected to equipment. The bus bars are mounted to a connector housing by molding with the bus bars arranged side by side. The kind of the resistance element of this connector can be altered in dependence on the kind of the $O_2$ sensor, and the element connection part of the bus bar and the lead wire of the resistance element are welded to each other by using laser beam.

The bus bars of this connector are mounted on the connector housing with the bus bars arranged side by side and penetrating through the housing. To mount the connector on equipment, an operator grips a pair of the equipment connection parts projected from the housing with the bus bars being arranged side by side in the same direction. Thus there is a fear that the bus bars will displace from each other about the connector housing like a seesaw. The connector is mounted on the periphery of the engine and is exposed to a high temperature during use. Thus the bus bars repeatedly are subjected to thermal expansion and shrinkage. Therefore the connector has a problem in that a force for separating the bus bars and the lead wire from each other is applied to the portion where the bus bars and the lead wire are connected. Hence, the portion where the bus bars and the lead wire are connected are likely to crack and the reliability in the connection between the lead wire and the bus bars deteriorates.

The invention has been completed based on the above-described situation. It is an object of the invention to improve reliability in the connection between a lead wire and bus bars by relaxing a force of separating the bus bars and the lead wire from each other.

SUMMARY OF THE INVENTION

The present invention relates to a connector that incorporates an electronic element having a pair of lead wires at both ends of an electronic element body. The connector also includes two bus bars each having an element connection part to which one of the lead wires is connected and an equipment connection part connected to equipment. The bus bars are mounted on a synthetic resin housing by molding with the bus bars being arranged side by side and penetrating through the housing. The lead wire and the element connection part are fixed to each other. One end of each of the bus bars projects from an upper surface of the housing and defines the element connection part. The other end of each of the bus bars projects from a lower surface of the housing and defines the equipment connection part. The lead wire has two straight parts extended in opposite directions from both end surfaces of the resistance element body and a stress-absorbing part absorbing a force of flexing the lead wire generated when the bus bars are displaced about the connector housing like a seesaw.

The bus bars may displace from each other about the housing like a seesaw due to gripping of the equipment connection part or when the bus bars repeat thermal expansion and shrinkage. However, the stress-absorbing part is capable of absorbing the force of flexing the lead wire and thereby relaxes the force of separating the element connection part and the lead wire from each other when the force is applied to the portion where the element connection part and the lead wire are connected to each other. Thus, it is possible to improve the reliability in the connection between the lead wire and the bus bar.

The connector may be constructed so that both element connection parts are plate-shaped and are arranged side by side in the same plane. Each of the element connection parts preferably has a slit formed by cutting an end thereof. The lead wire preferably is fixed to an inner surface of the slit with the lead wire intersecting the element connection parts. An axis of the resistance element body preferably is parallel with and offset from a line connecting both element connection parts to each other. The stress-absorbing part preferably is a bent part formed by bending the lead wire between the straight part and the element connection part in a plane orthogonal to a direction in which the element connection part is projected.

According to this construction, the axis of the electronic element body is disposed parallel to and offset from the direction in which both element connection parts are arranged side by side. This construction allows the bent part to have a larger radius of curvature than the radius of curvature the bent part has when the electronic element body is disposed between both element connection parts. Thus, the bent part securely absorbs the force of flexing the lead wire and is capable of relaxing the force acting on the portion at which the element connection part and the lead wire are connected to each other.

Each of the lead wires may have the bent part at one portion thereof and is L-shaped. This construction allows the bent part to flex easily in the direction in which both bus bars are displaced from each other.

The electronic element-incorporating connector may be constructed so that both element connection parts are plate-shaped and opposed to each other, and each of the element connection parts has a slit formed by cutting an end thereof. The lead wire is fixed to an inner surface of the slit with the lead wire intersecting the element connection parts. The electronic element body is disposed in a region sandwiched between the element connection parts and the stress-absorbing part is a bent part formed by bending the lead wire between the straight part and the element connection part.

According to this construction, the electronic element body and the bent part are disposed in the region sandwiched between both element connection parts. Disposing the electronic element and the element connection parts in the region sandwiched between both element connection parts allows the region in which the electronic element and the element connection parts are disposed to be smaller than the construction in which the electronic element body is disposed in a region other than the region sandwiched between both element connection parts.

The connector may be constructed so that each of the lead wires has two bent parts and is crank-shaped. Hence, an axis of the electronic element body can be parallel to and offset from a direction in which both element connection parts are arranged side by side. This construction allows the bent part to flex easily in the direction in which the bus bars are displaced from each other.

The connector may be constructed so that both element connection parts are plate-shaped and opposed to each other. Each of the element connection parts has a slit formed by cutting an end thereof and the lead wire is fixed to an inner surface of the slit. An axis of the electronic element body is disposed obliquely to a direction in which both element connection parts are arranged side by side in a region sandwiched between the element connection parts. The stress-absorbing part is composed of the straight part positioned between the electronic element body and the element connection part and a bent part formed by bending the lead wire at a position where the lead wire penetrates into the slit.

According to this construction, the axis of the electronic element body is oblique to the line connecting both element connection parts to each other. Thus, the stress-absorbing part is capable of relaxing the force acting on the portion at which the element connection part and the lead wire are joined when the bus bars are twisted about the housing in the direction in which the direction of the axis of the electronic element body is parallel with the direction of the line connecting both element connection parts to each other.

The connector housing may have two holding strips holding the electronic element body. Thus, the electronic element body will not loosen in a case where the bus bars elastically deform about the housing.

In summary, it is possible to improve the reliability in the connection between the bus bars and the lead wire by relaxing the force of separating the bus bars and the lead wire from each other.

DETAILED DESCRIPTION OF THE PREFERRED EMBODIMENTS

A first embodiment of the invention is described below with reference to FIG. 1 through 9, which show a resistance element-incorporating connector 10 as an example of an electronic element-incorporating connector.

Figure 3:
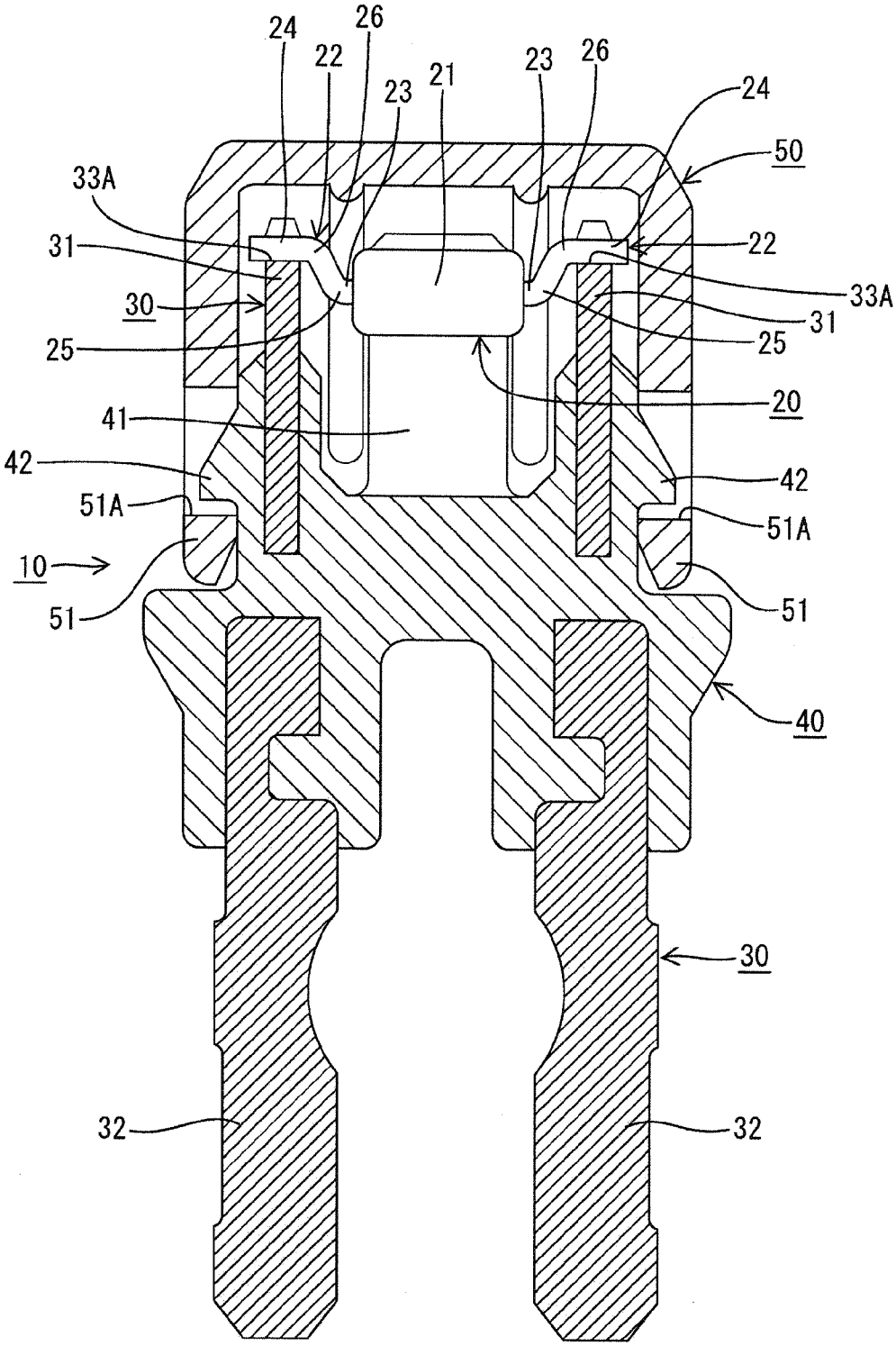
FIG. 3 is a sectional view showing the state in which the cover is mounted on the resistance element-incorporating connector of the first embodiment, when the resistance element-incorporating connector and the cover are seen from the front.

As shown in FIG. 3, the connector 10 is composed of a resistance element 20, a housing 40 in which two side-by-side bus bars 30 connected to the resistance element 20, a housing 40 molded around parts of the bus bars 30 and a cover 50 mounted on the housing 40.

Figure 5:
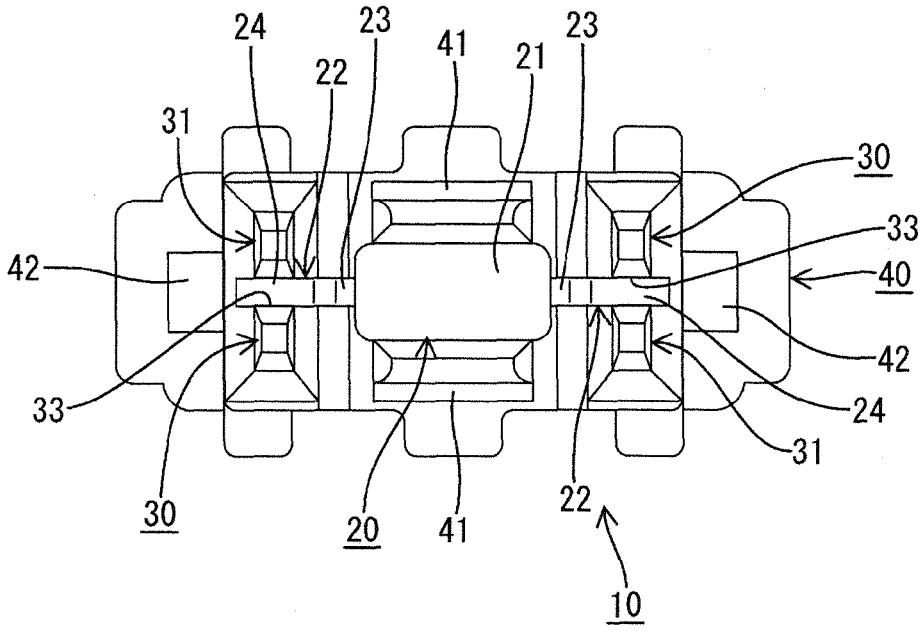
FIG. 5 is a plan view showing the resistance element-incorporating connector of the first embodiment.

As shown in FIGS. 3 and 5, the resistance element 20 has an approximately columnar resistance element body 21 and two round lead wires 22 that project respectively from two opposite end surfaces of the resistance element body 21.

Figure 4:
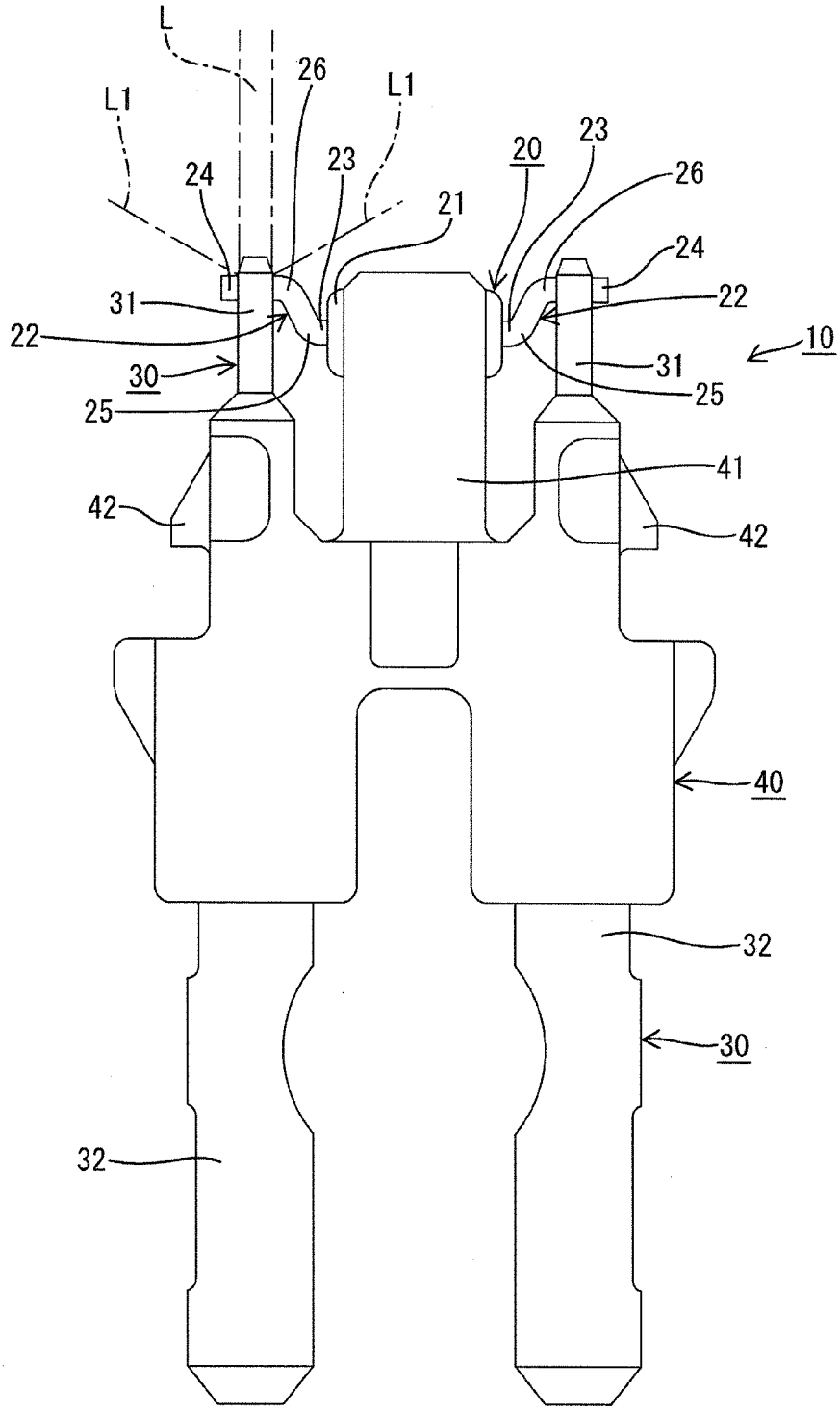
FIG. 4 is a front view showing the resistance element-incorporating connector of the first embodiment.

The housing 40 is made of synthetic resin. As shown in FIGS. 3 and 4, the bus bars 30 are mounted on the housing 40 by molding a material of the bus bars 30 with the bus bars 30 arranged side by side. Approximately the centers of both bus bars 30 in a vertical direction are connected to each other to form the bus bars 30 approximately in the shape of a letter H in a front view. As shown in FIG. 4, both bus bars 30 penetrate through the housing 40, which, as shown in FIG. 5, is long in a width direction (left-to-right direction in FIG. 5) in which the bus bars 30 are arranged side by side.

The bus bar 30 is formed from a highly conductive metal plate that is punched by a press machine. Thereafter the formed metal plate is twisted and perpendicularly bent at an approximately central portion thereof in a vertical direction. One end of each bus bar 30 projects from an upper surface of the housing 40 to define an element connection part 31. The element connection parts 31 are disposed in opposition to each other. The other end of each of the bus bars 30 projects from a lower surface of the housing 40 to define an equipment connection part 32. The equipment connection parts 32 are arranged side by side in the same plane in the width direction of the housing 40.

Figure 6:
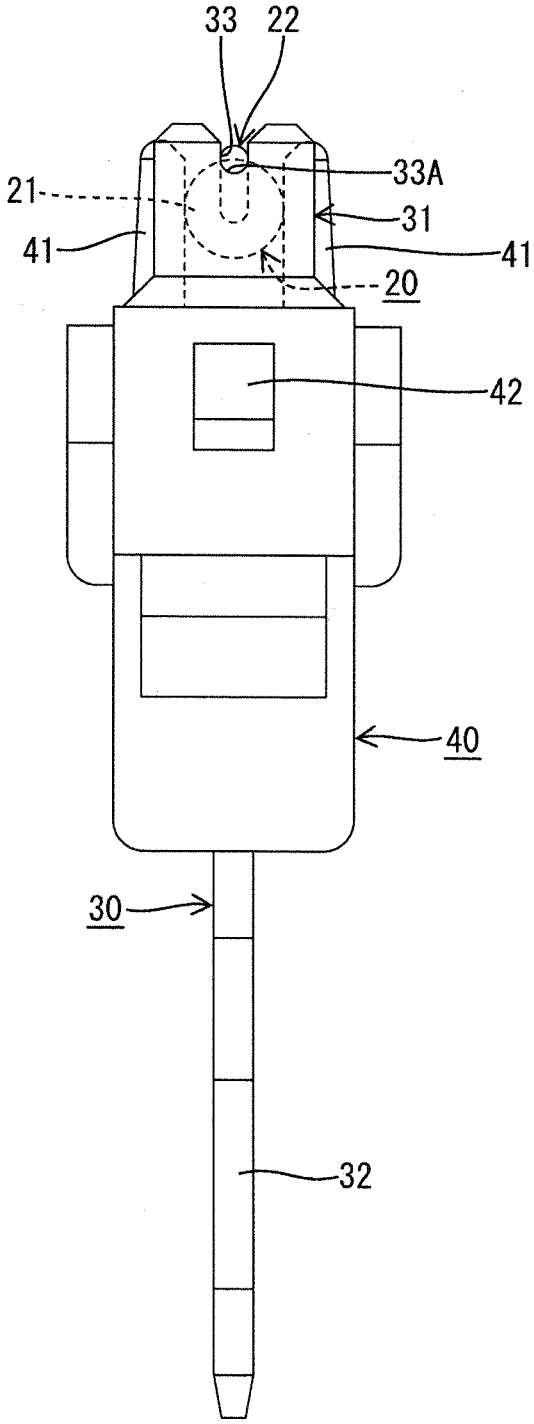
FIG. 6 is a side view showing the resistance element-incorporating connector of the first embodiment.
Figure 7:
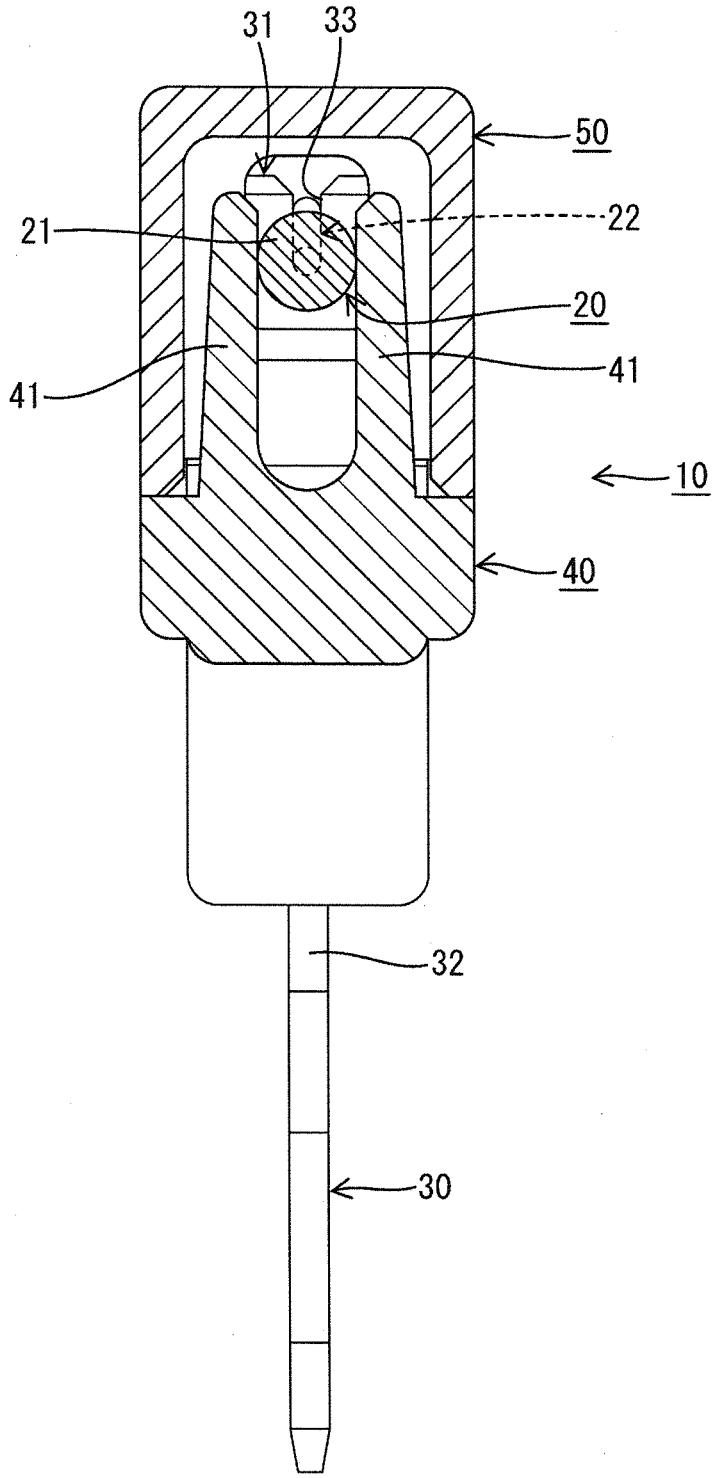
FIG. 7 is a sectional view showing the resistance element-incorporating connector of the first embodiment when the resistance element-incorporating connector is seen from the side.

As shown in FIG. 6, a vertically extended slit 33 is formed at a laterally central portion of each element connection part 31 and extends down from an upper end surface thereof. The width of the slit 33 is almost equal to the outer diameter of the lead wire 22 of the resistance element 20. The front of the slit 33 is tapered and widened toward the outside.

As shown in FIGS. 4 and 5, the resistance element 20 spans between both element connection parts 31. The lead wires 22 and the slits 33 are welded to each other respectively by laser welding. The lead wires 22 of the resistance element 20 are fixed to the element connection parts 31 respectively with the lead wires 22 disposed orthogonally to the element connection parts 31.

Two holding strips 41 are formed on the upper surface of the housing 40 between the element connection parts 31. The holding strips 41 are disposed at a widthwise central portion of the upper surface of the housing 40. The resistance element body 21 of the resistance element 20 disposed on the upper surface of the housing 40 is held sandwiched between the holding strips 41.

The cover 50 is made of synthetic resin mounted on an upper part of the housing 40 to cover and protect both element connection parts 31 and the resistance element 20.

Figure 1:
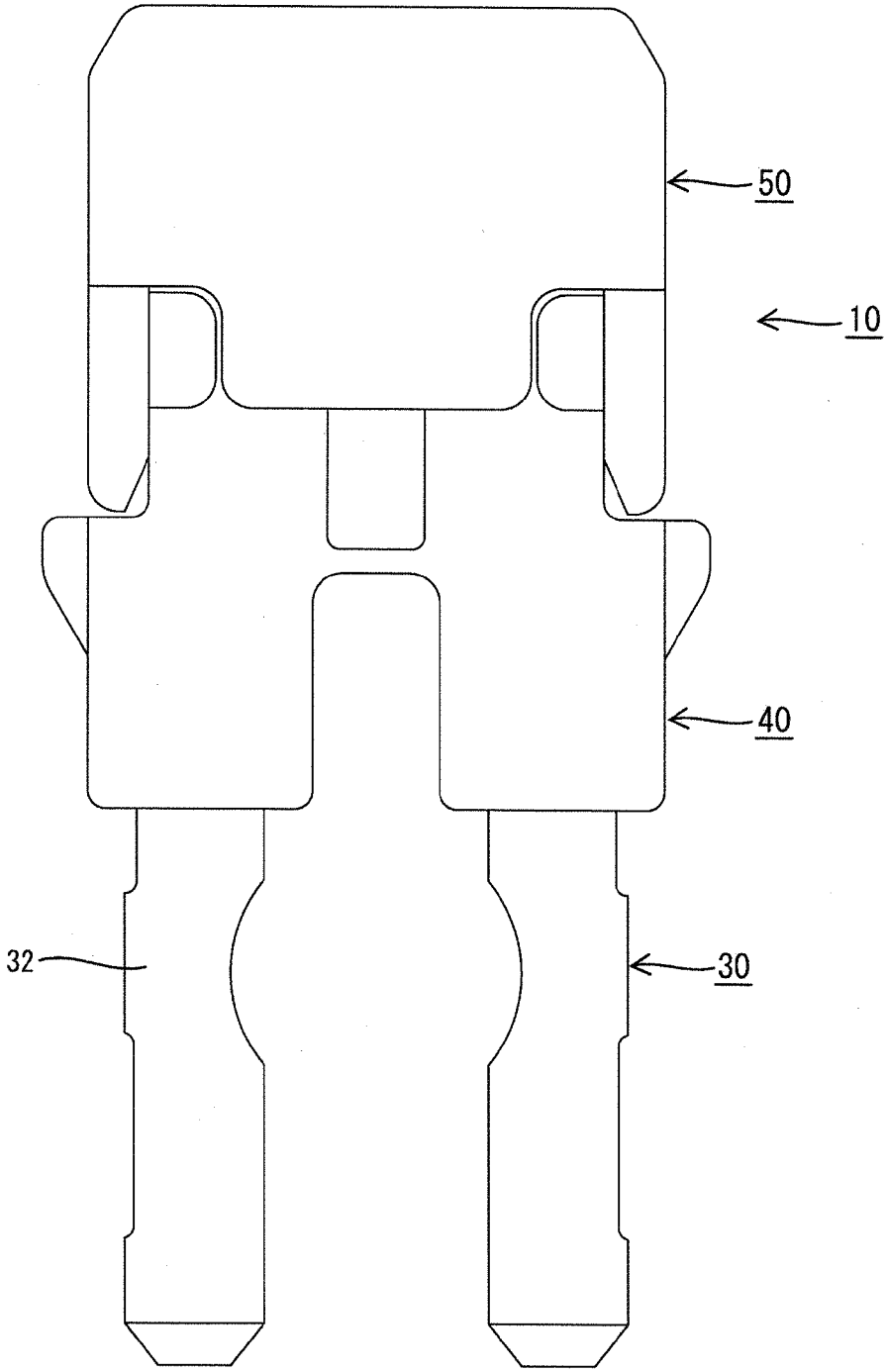
FIG. 1 is a front view showing a state in which a cover is mounted on a resistance element-incorporating connector of a first embodiment.
Figure 2:
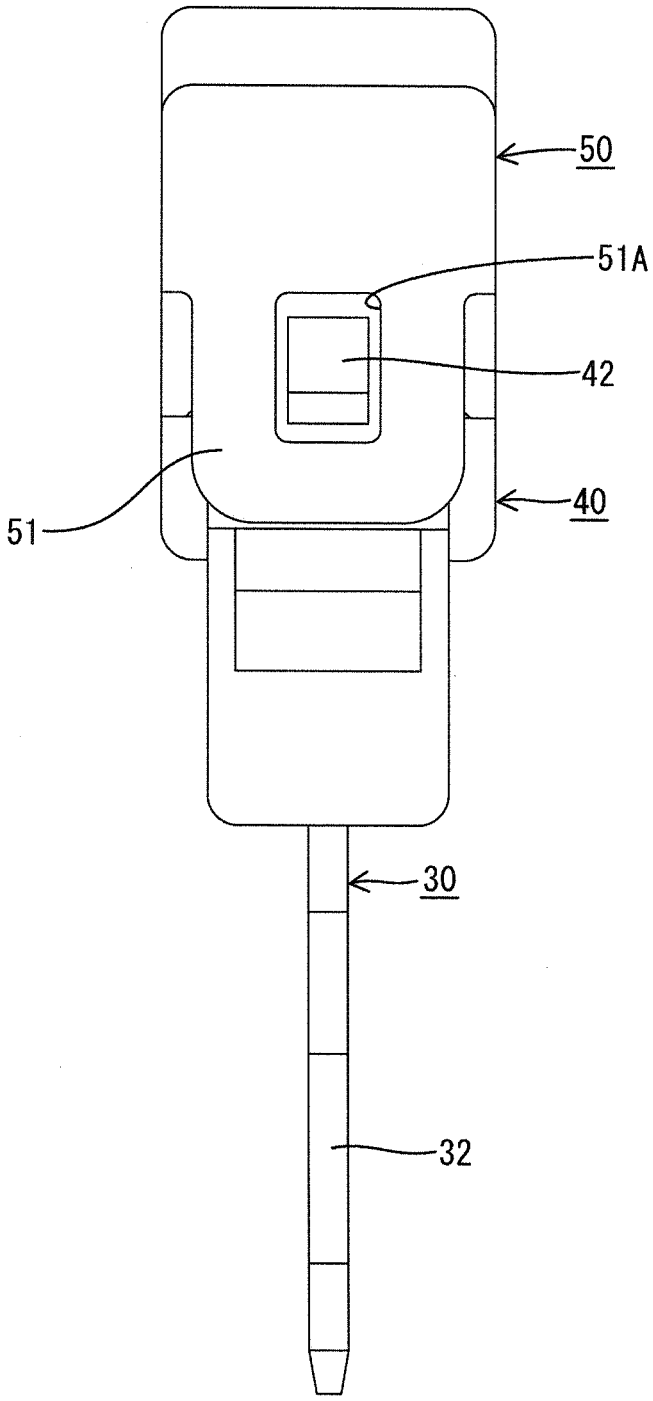
FIG. 2 is a side view showing the state in which the cover is mounted on the resistance element-incorporating connector of the first embodiment.

As shown in FIGS. 1 through 3, the cover 50 is hood-shaped and is capable of accommodating the upper part of the housing 40. A locking piece 51 is provided on each side surface of the cover 50 and each locking piece 51 has a locking hole 51A. A locking projection 42 is formed on each side surface of the housing 40 can be locked in the locking holes 51A of the locking pieces 51 respectively. Thus, the cover 50 is prevented from dropping from the housing 40.

The lead wire 22 of the resistance element 20 has straight parts 23 extended in opposite directions from end surfaces of the resistance element body 21, two bus bar connection parts 24 inserted into the slits 33 of the element connection parts 31 respectively, and first and second bends 25, 26 between the straight part 23 and the bus bar connection part 24 at both sides of the resistance element 20. As shown in FIGS. 3 and 4, the straight parts 23 project straight from respective end surfaces of the resistance element body 21. The bus bar connection parts 24 are inserted into inner end surfaces 33A of the slits 33 respectively orthogonally to the element connection part 31 and project from the slits 33 respectively in a thickness direction of the element connection part 31.

The first bend 25 is formed by elastically deformably bending the lead wire 22 obliquely up at an end of the straight part 23. The second bend 26 is formed by elastically deformably bending the lead wire 22 extended straight from the first bend 25 toward the element connection part 31 at a position on a level with the inner end surface 33A of the slit 33 of the element connection part 31. Thus, the lead wire 22 is crank-shaped due to the configuration and disposition of the first and second bends 25 and 26. The first and second bends 25 and 26 are elastically deformable in the direction in which the resistance element body 21 and an end of the lead wire 22 approach each other.

The bending angles of the first and second bend 25 and 26 are almost equal. Thus, the axis of the resistance element body 21 is parallel with a line connecting both bus bar connection parts 24 to each other and offset down from the location of the bus bar connection parts 24. More specifically, the resistance element body 21 is parallel with the direction in which both bus bars 30 are arranged side by side within the region sandwiched between the element connection parts 31 and disposed by offsetting the resistance element body 21 toward the slit-forming direction (toward the inner end surface 33A of the slit 33).

The connector 10 is mounted on equipment such as an engine having an unshown $O_2$ sensor. One connector 10 is taken out of a plurality of the resistance element-incorporating connectors 10 prepared in advance. The operator grips a pair of the equipment connection parts 32, and hence two the bus bars 30 may displace from each other about the housing 40 like a seesaw.

The connector 10 of FIGS. 1-9 may be used in an engine where temperature is high and the bus bars 30 may displace elastically due to repeated thermal expansion and shrinkage. As a result, a flexion force is applied to the lead wire 22 of the resistance element 20. More particularly, a force is applied to a portion where the bus bar connection part 24 and the inner end surface 33A are joined. This force could separate the bus bar connection part 24 of the resistance element 20 and the inner end surface 33A of the slit 33 of the element connection part 31 from each other. Thus there is a fear that the area where the bus bar connection part 24 and the inner end surface 33A are joined will crack. However, the connector 10 has the elastically deformable first bent part 25 between the straight part 23 of the resistance element 20 and the bus bar connection part 24. The first bent part 25 absorbs the force of flexing the lead wire 22 and thus prevents cracking of the portion at which the bus bar connection part 24 and the inner end surface 33A are joined.

The lead wire 22 has the first and second bent parts 25 and 26 to absorb the force of flexing the lead wire 22 can be much absorbed. Further it is possible to improve reliability in the connection between the lead wire 22 of the resistance element 20 and the element connection part 31 of the bus bar 30.

The resistance element body 21 is sandwiched between the holding strips 41 on the upper surface of the housing 40. Thus, the resistance element body 21 will not loosen and will hold the resistance element body 21 in a stable state when the lead wire 22 deforms.

The bus bar connection part 24 of the resistance element 20 and the inner surface of the slit 33 of the element connection part 31 are welded to each other by laser welding. More specifically, as shown in FIG. 4, the inner end surface 33A of the slit 33 and the bus bar connection part 24 are melted by irradiating the periphery of the bus bar connection part 24 placed on the inner end surface 33A of the slit 33 with a laser beam L from a position above the element connection part 31 to fix the bus bar connection part 24 and the inner end surface 33A of the slit 33 together.

The emitted laser beam L strikes against the upper surface of the bus bar connection part 24. A part of the laser beam L1 is reflected from the upper surface of the bus bar connection part 24, thus diffusing from an open portion of the slit 33. The resistance element body 21 is at the position offset toward the slit-forming direction to avoid the reflected laser beam L1. Thus, the reflected laser beam L1 will not strike against the resistance element body 21 and the resistance element body 21 will not burn out.

Figure 8:
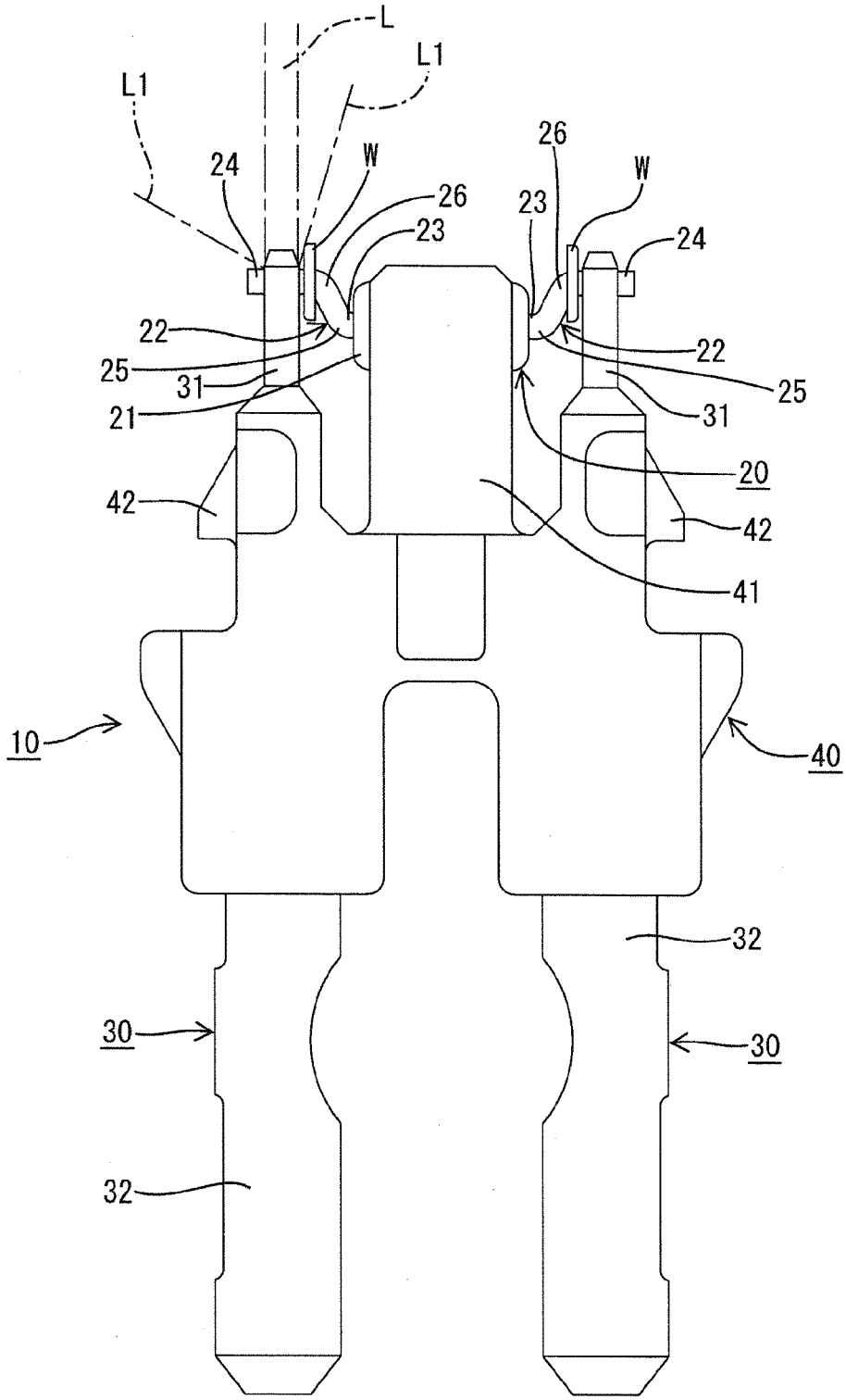
FIG. 8 is a front view showing a state in which a light-shielding washer is mounted on the resistance element-incorporating connector of the first embodiment.
Figure 9:
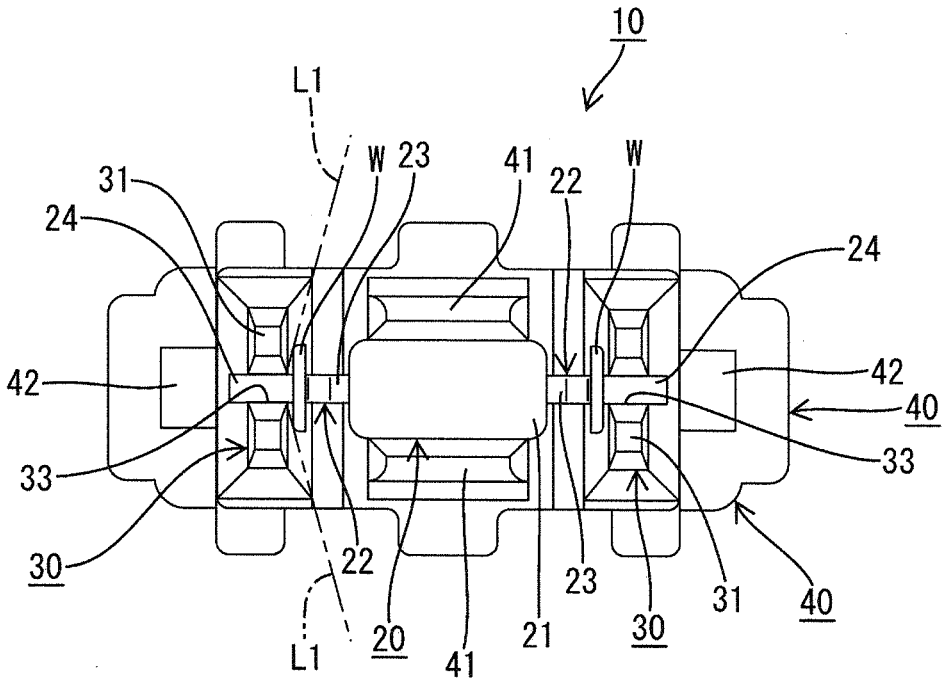
FIG. 9 is a plan view showing the state in which the light-shielding washer is mounted on the resistance element-incorporating connector of the first embodiment.

As shown in FIGS. 8 and 9, a light-shielding washer W is mounted on the bus bar connection part 24 between the element connection part 31 and the second bend 26 to shield the reflected laser beam L1 that has been reflected from the upper surface of the bus bar connection part 24 and has leaked from the open portion of the slit 33 and to prevent the reflected laser beam L1 from striking against the resistance element body 21. The light-shielding washer W may be a copper washer that reflects the reflected laser beam L1 at a high reflectivity.

Figure 10:
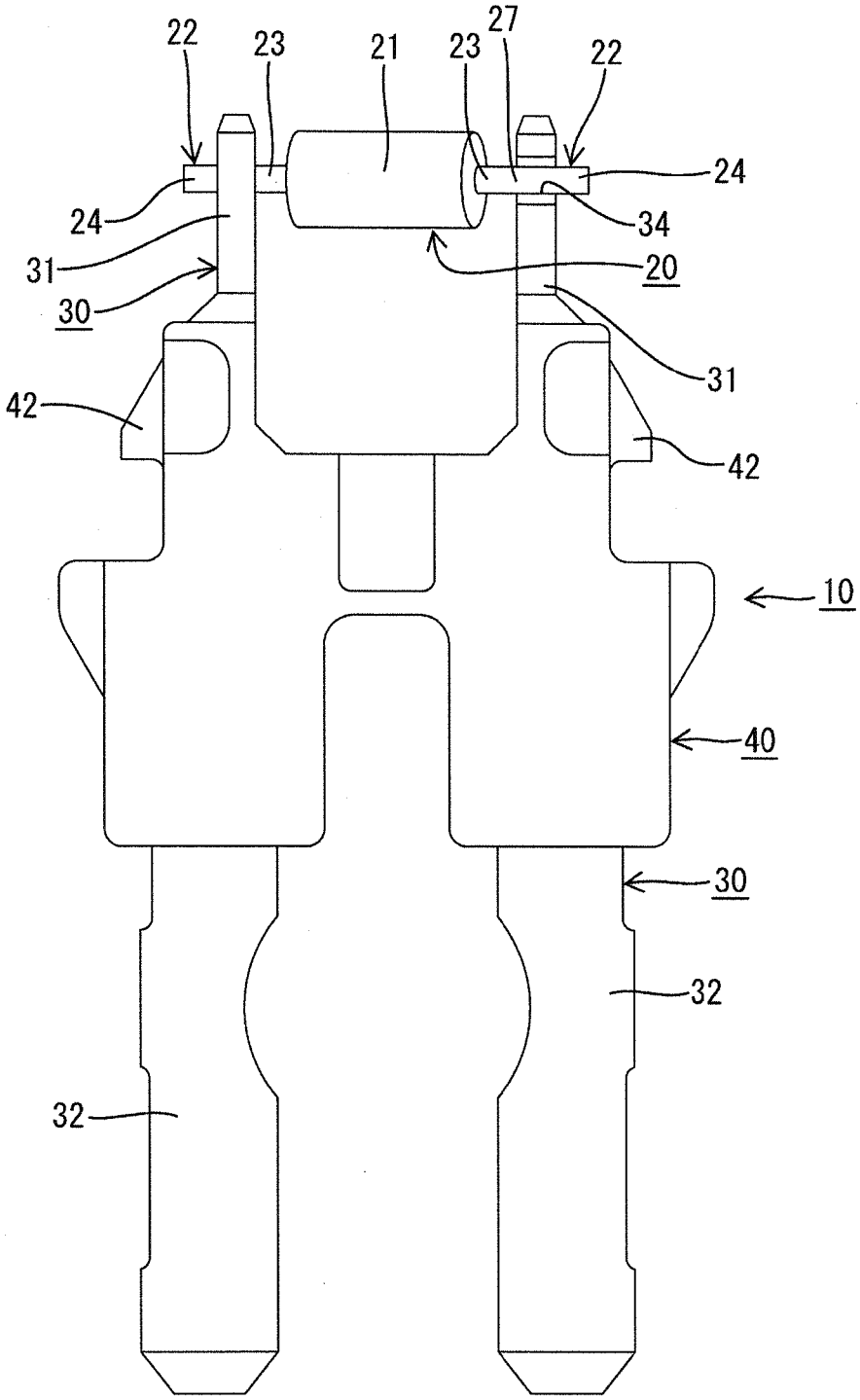
FIG. 10 is a front view showing a resistance element-incorporating connector of a second embodiment.

A second embodiment of the invention is described with reference to FIGS. 10 through 12. The second embodiment differs from the first embodiment with respect to the direction in which the slit 33 formed on the element connection part 31, the form of the resistance element body 21 of the first embodiment, and the bending form of the lead wire 22 of the resistance element 20. The description of the construction, action, and effect of parts of the second embodiment that are the same as the first embodiment are omitted and those parts merely are identified by the reference numerals used in the first embodiment.

Figure 11:
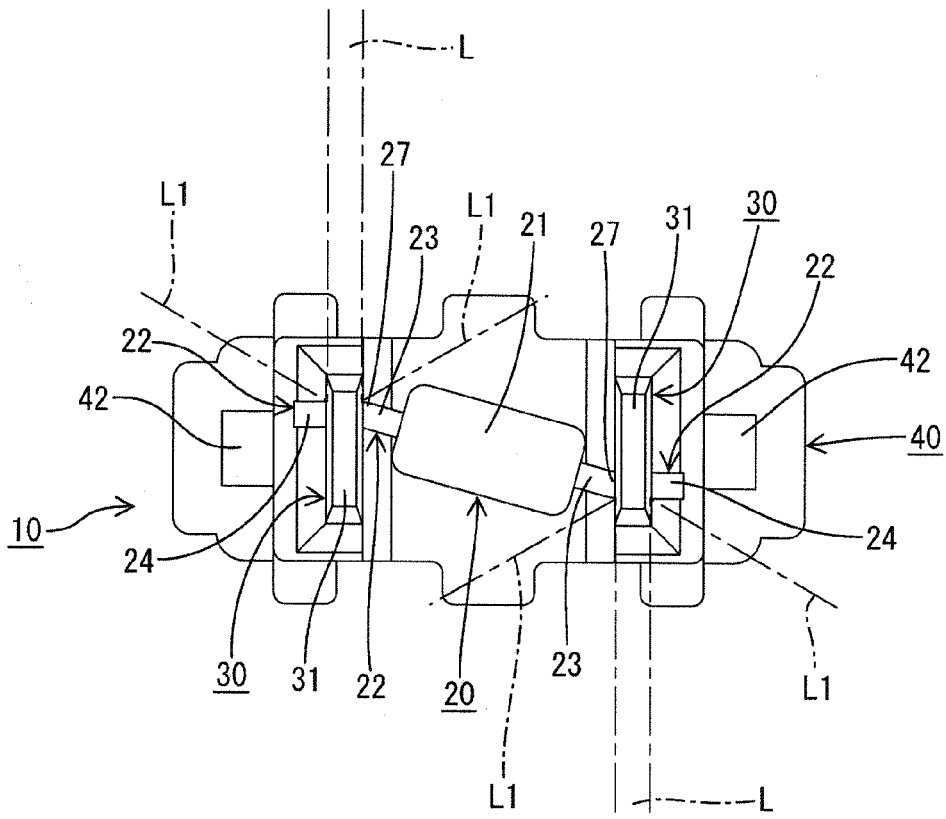
FIG. 11 is a plan view showing the resistance element-incorporating connector of the second embodiment.
Figure 12:
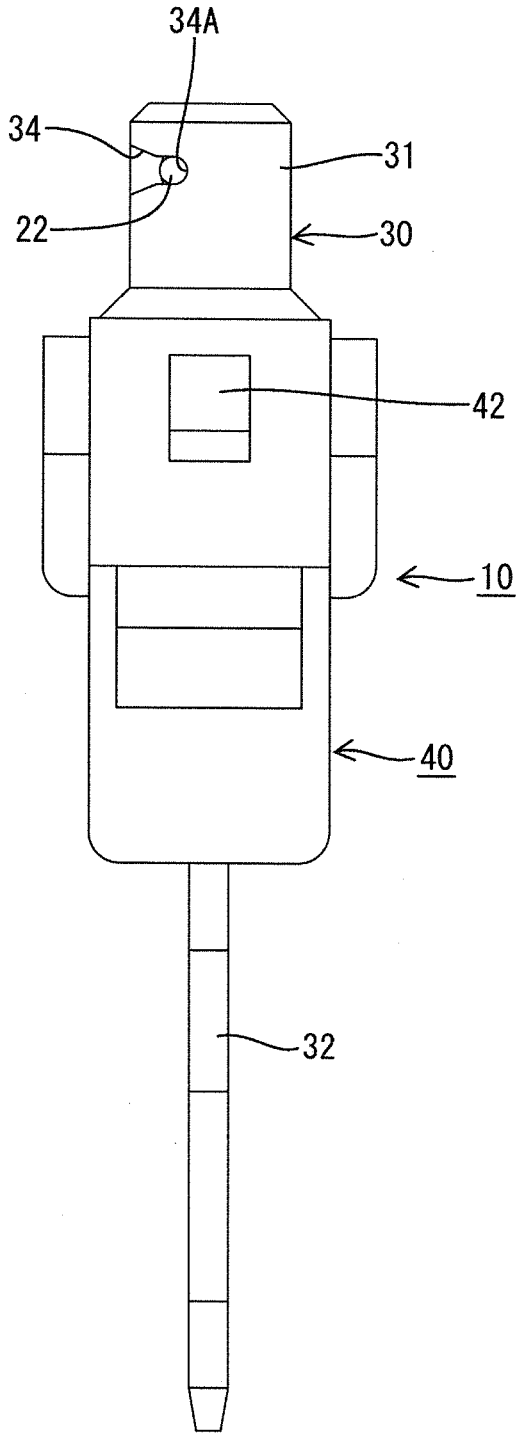
FIG. 12 is a side view showing the resistance element-incorporating connector of the second embodiment.

As shown in FIG. 12, a slit 34 in the second embodiment is formed by cutting both element connection parts 31 in opposite directions (vertical direction in FIG. 11) in a plane orthogonal to the direction in which both element connection parts 31 project from the upper surface of the housing 40. The configuration of the slit 34 is similar to the slit 33 of the first embodiment.

As shown in FIG. 11, the resistance element 20 is disposed so that the axis of the resistance element body 21 is coaxial with a line connecting inner end surfaces 34A of the slits 34 of both element connection parts 31 to each other. That is, the axis of the resistance element body 21 is disposed obliquely to the direction in which both element connection parts 31 are arranged side by side.

Each lead wire 22 has only one bend 27 between the straight part 23 and the bus bar connection part 24. The bend 27 is formed by bending the lead wire 22 so that the peripheral surface of the lead wire 22 is along the inner end surface 34A of the slit 34 at a position where the lead wire 22 penetrates the slit 34. That is, the bend 27 is bent toward the inner end surface 34A of the slit 34 at a position where the lead wire 22 extended from its front end toward the resistance element body 21 is projected from the slit 34 to the resistance element body 21. The bend 27 is elastically deformable in the direction in which the resistance element body 21 and an end of the lead wire 22 approach each other and depart from each other.

The bends 27 absorb a force of flexing the lead wire 22 when the bus bars 30 are displaced from each other about the housing 40 like a seesaw and thus the bends 27 restraining cracking of the portion at which the bus bar connection part 24 and the inner end surface 33A of the slit 34 are joined.

The axis of the resistance element body 21 of the second embodiment is oblique to the direction in which the element connection parts 31 are arranged side by side. The bus bars 30 may be twisted and flexed about the housing 40 in such a way that the direction of the axis of the resistance element body 21 is the same as the direction in which the element connection parts 31 are arranged. However, the straight part 23 and the bends 27 absorb the force applied to the portion at which the bus bar connection part 24 and the inner end surface 33A of the slit 34 are joined and thus restrain cracking at this location.

The bus bar connection part 24 of the resistance element 20 and the slit 33 are laser welded, as shown in FIG. 11. More particularly, the periphery of the bus bar connection part 24 is placed on the inner end surface 33A of the slit 33 and is irradiated with the laser beam L in the slit-forming direction. The bend 27 of the second embodiment offsets the resistance element body 21 toward the slit-forming direction (toward the inner end surface 34A of the slit 34) similar to the first embodiment. Hence, the laser beam L1 will not reflect from the bus bar connection part 24 and strike against or burn out the resistance element body 21.

The third embodiment of the invention is described below with reference to FIGS. 13 through 17. The third embodiment differs from the first and second embodiments with respect to the disposition of the resistance element body 21 relative to the housing 40, the bending form of the lead wire 22, and the cover 50. Parts of the third embodiment that are the same as the first two embodiments are identified by the same reference numerals, but are not described again.

Figure 13:
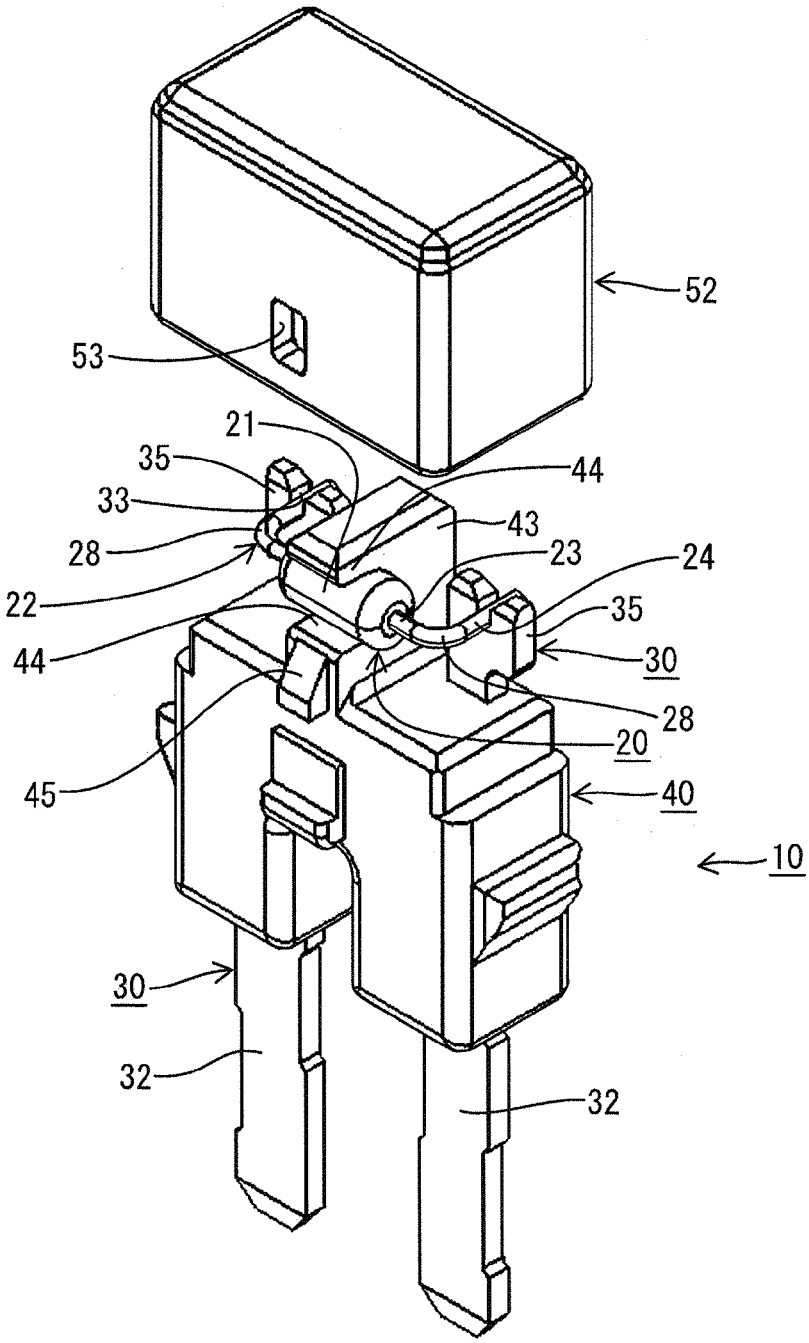
FIG. 13 is a perspective view showing a state before a cover is mounted on a resistance element-incorporating connector of a third embodiment.
Figure 14:
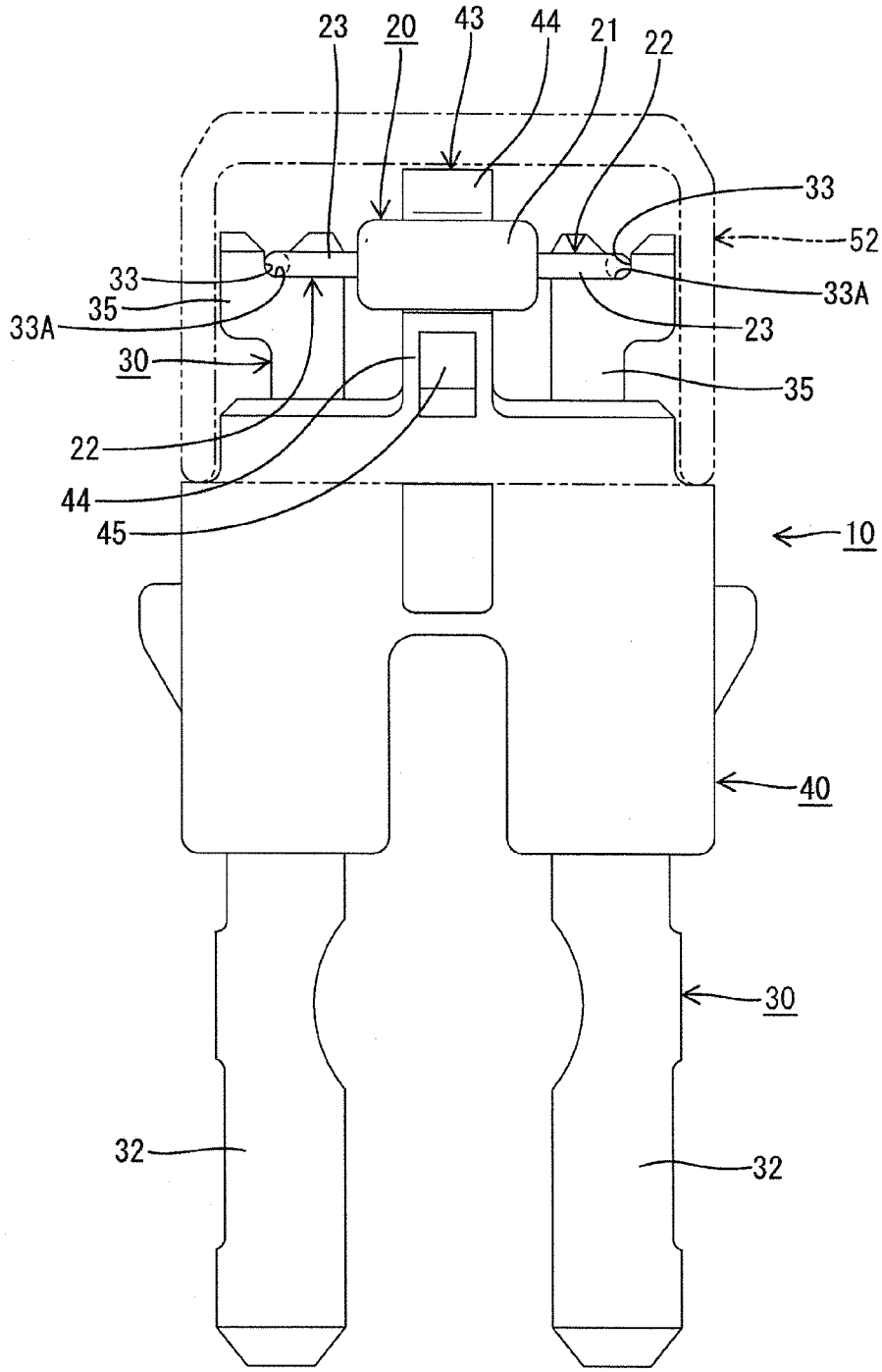
FIG. 14 is a front view showing a resistance element-incorporating connector of a third embodiment.
Figure 16:
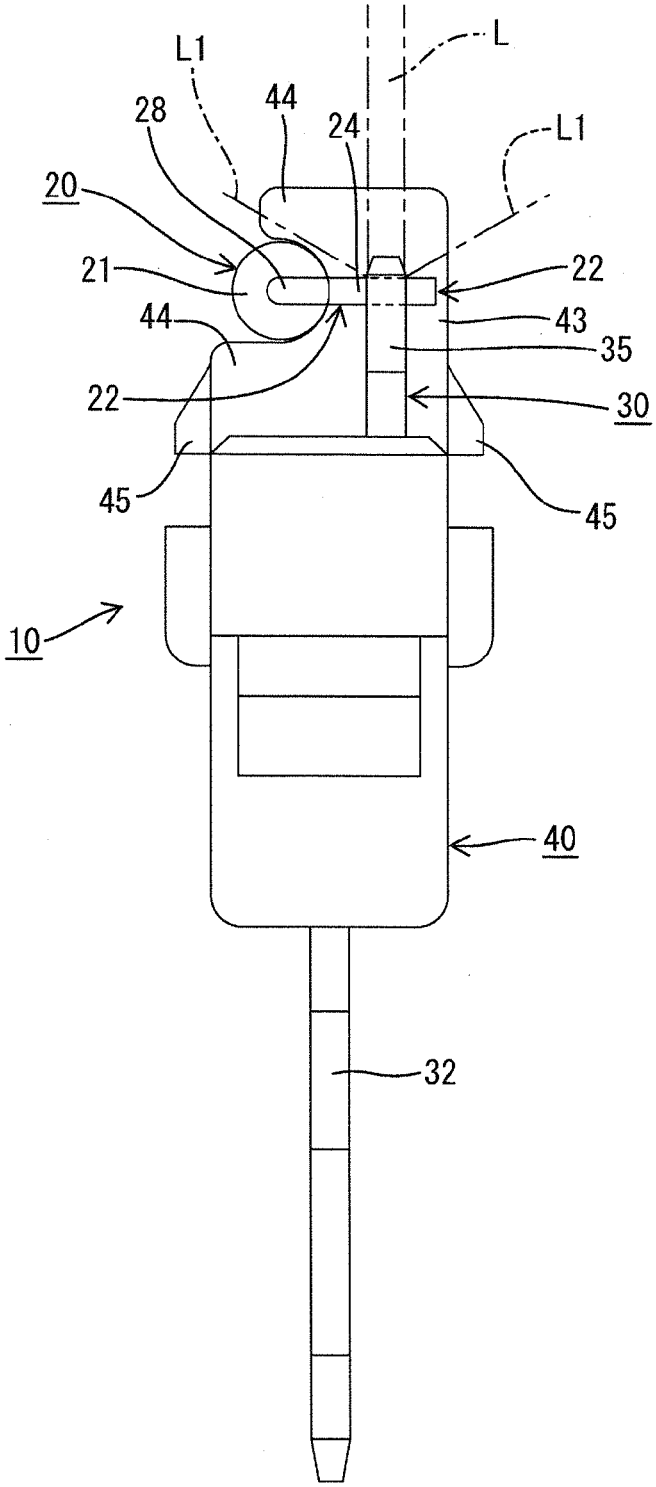
FIG. 16 is a side view showing the resistance element-incorporating connector of the third embodiment.

The element connection parts 35 of the third embodiment are arranged side by side on the upper surface of the housing 40 and are in the same plane in the width direction of the housing 40. A holding wall 43 is erected between the element connection parts 35 and opposed upper and lower holding strips 44 are provided at upper and lower ends of the holding wall 43 respectively. The holding strips 44 are approximately U-shaped in a side elevation and open sideways The distance between the holding strips 44 almost equals the outer diameter of the resistance element body 21. As shown in FIGS. 13 and 16, the resistance element body 21 of the resistance element 20 is held between the holding strips 44.

Figure 15:
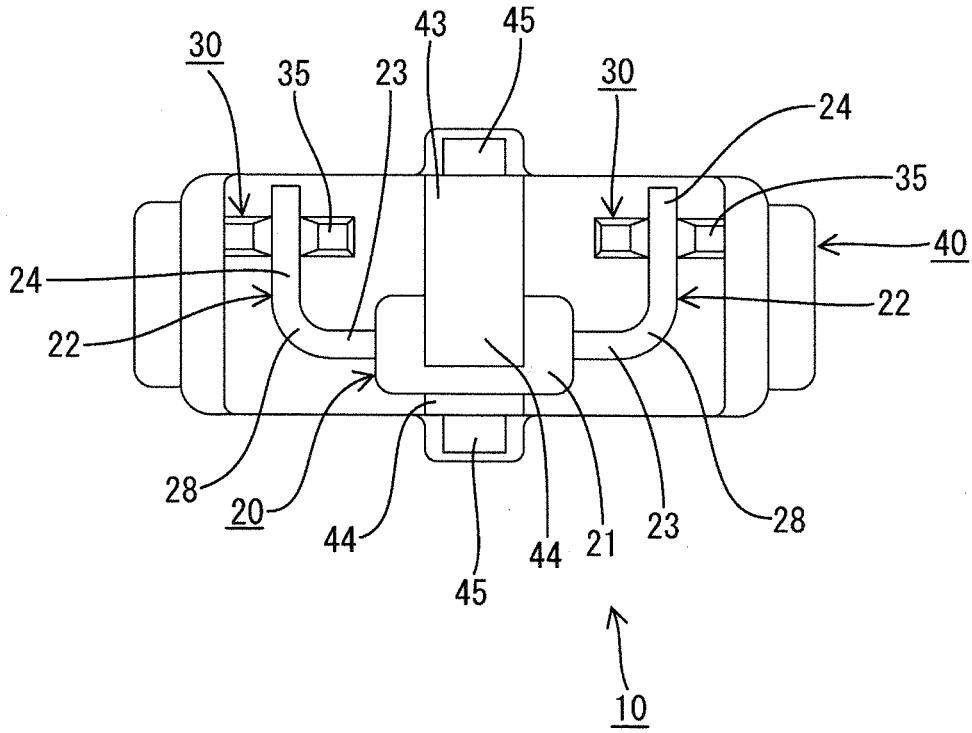
FIG. 15 is a plan view showing the resistance element-incorporating connector of the third embodiment.
Figure 17:
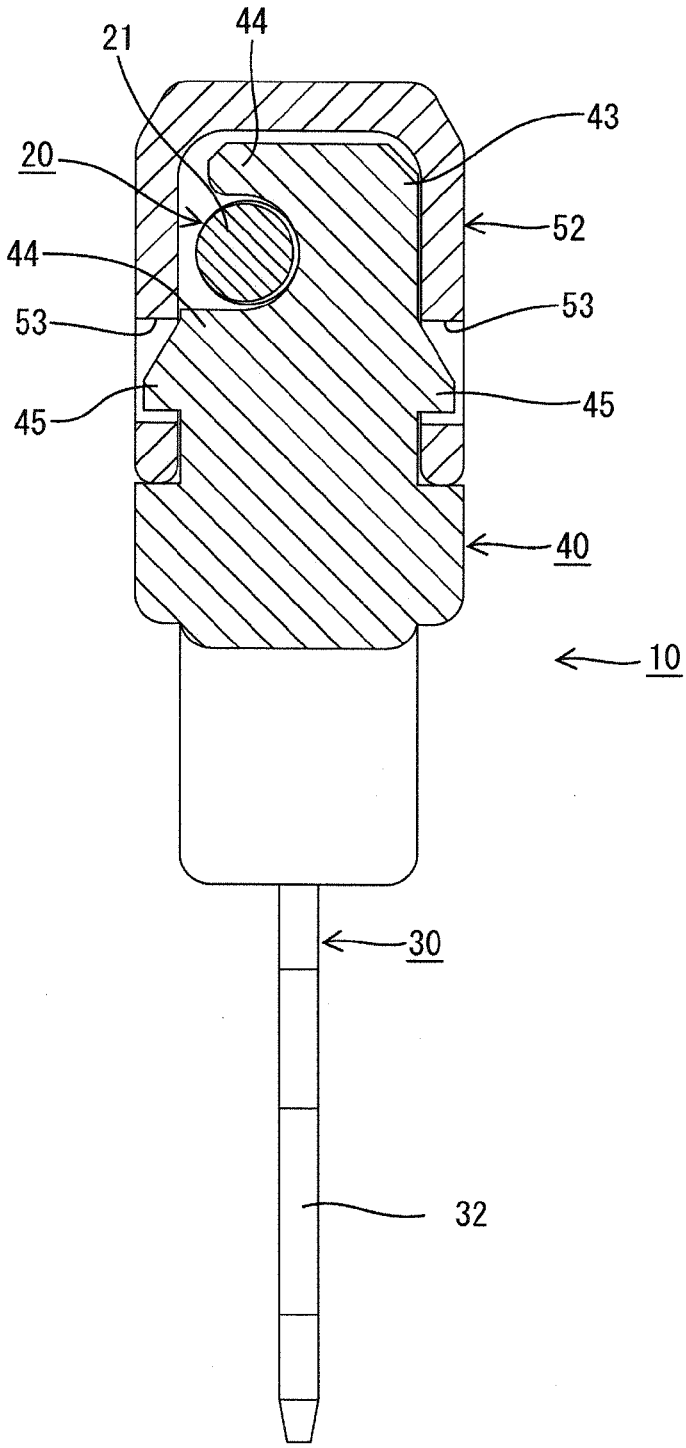
FIG. 17 is a sectional view showing the resistance element-incorporating connector of the third embodiment when the resistance element-incorporating connector is seen from the side.

As shown in FIG. 17, a locking projection 45 is formed on each side surface of the housing 40 in its thickness direction (vertical direction in FIG. 15). Each locking projection can engage a locking hole 53 on a cover 52 to hold the cover 52 on the housing 40.

The resistance element body 21 of the resistance element 20 is arranged alongside the line connecting the element connection parts 35 to each other in the thickness direction of the housing 40 and offset from that line.

Each lead wire 22 has only one bend 28 disposed between the straight part 23 and the bus bar connection part 24. The bend 28 is formed by bending the lead wire 22 between the straight part 23 and the slit 33 of the element connection part 35 in a horizontal plane orthogonal to the direction in which the bus bars 30 project from the upper surface of the housing 40. Similar to the first embodiment, the bend 28 is elastically deformable in the direction in which the straight part 23 and the bus bar connection part 24 approach each other and depart from each other.

That is, because the resistance element body 21 is offset from the line connecting the element connection parts 35 to each other. A region in which the bend 28 is formed can be secured more widely than a case in which the resistance element body 21 is sandwiched between both element connection parts 35. Consequently the bend 28 can have a large radius of curvature. The bends 28 absorb the force of flexing the lead wire 22 when the bus bars 30 are displaced from each other about the housing 40 like a seesaw Thus, the bends 28 prevent cracking of the portion where the bus bar connection part 24 joins the inner end surface 33A of the slit 33.

The slits 33 open in a direction intersecting the direction in which the bus bars 30 are arranged side by side. Thus, the bus bar connection part 24 and the element connection part 35 are orthogonal to each other. Furthermore, the direction in which the bus bars 30 elastically deform and the direction in which the lead wire 22 is pulled out from the slit 33 are orthogonal to each other. Accordingly, movement of the lead wire 22 in the direction in which the bus bars 30 are displaced is restricted when the bus bars 30 are displaced from each other about the housing 40 like a seesaw. This is unlike a case in which the bus bar connection part 24 is connected to a slit that opens in the same direction as the direction in which both bus bars are arranged. As a result, it is possible to relax the force of separating the bus bar connection part 24 and the inner end surface 33A of the slit 33 from each other and improve the reliability in the connection between the bus bars 30 and the lead wire 22.

The bus bar 30 can be formed by punching a metal plate with a press machine and without bending the bus bar 30. Thus the bus bar 30 is excellent in workability.

The bus bar connection part 24 of the resistance element 20 of the third embodiment is laser welded at the slit 33, similar to the first embodiment. The periphery of the bus bar connection part 24 placed on the inner end surface 33A of the slit 33 is irradiated with the laser beam L from a position above the element connection part 35, namely, toward the inner end surface 33A of the slit 33. The bus bar connection part 24 of the resistance element 20 in the third embodiment is orthogonal to the straight part 23, as shown in FIG. 15. Hence, the axis of the resistance element body 21 is deviated from the axis of the bus bar connection parts 24 at the slit 33. Accordingly, the reflected laser beam L1 that has leaked from the open portion of the slit 33 will not strike against and burn out the resistance element body 21.

As described above, in any of the embodiments of the present invention, when both bus bars 30 are displaced from each other about the housing 40 like a seesaw, the bend absorbs the force of flexing the lead wire 22 and thus relaxes the force of separating the bus bar connection part 24 and the inner end surface of the slit from each other. Thus the bend prevents cracking at the portion where the bus bar connection part 24 and the inner end surface of the slit are connected to each other. Thereby it is possible to improve the reliability in the connection between the lead wire 22 of the resistance element 20 and the bus bar 30.

The lead wire 22 and the bus bar 30 are laser welded to each other. However, the resistance element body 21 of the resistance element 20 is disposed outside the region against which the reflected laser beam L1 strikes. Hence, the reflected laser beam L1 will not strike against and burn out the resistance element body 21.

The invention is not limited to the embodiments described above, and the following embodiments also are included in the scope of the invention.

In the first embodiment, the stress-absorbing part is constructed by forming the elastically deformable bend between the straight part 23 and the bus bar connection part 24. However, a coil-shaped or corrugate stress-absorbing part may be formed between the straight part 23 and the bus bar connection part 24.

One or two bends are formed between the straight part 23 and the element connection part 31 in the first embodiment. However, more or fewer bends can be provided.

The electronic element in the illustrated embodiments is the resistance element 20. However, other electronic elements can be provided, such as a capacitor, a diode, or the like having a pair of lead wires projected from both ends of an electronic element body.

The resistance element 20 has pin-shaped lead wires 22 in the illustrated embodiments. However, a prismatic lead wire 22 may be used.

The lead wire 22 and the bus bar 30 are fixed to each other by laser welding in the illustrated embodiments. However, the lead wire 22 and the bus bar 30 may be fixed to each other by methods, such as soldering, ultrasonic welding, and the like.

What is claimed is:

1. An electronic element-incorporating connector, comprising:

a housing made of synthetic resin;

two bus bars arranged side by side and mounted in the housing by molding so that the bus bars penetrate through the housing, each of the bus bars having an element connection part projecting from an upper surface of the housing and an equipment connection part projecting from a lower surface of the housing, the element connection parts being plate-shaped and arranged side by side in the same plane, and each of said element connection parts has a slit formed by cutting an end thereof; and an electronic element having a body with opposite ends spaced apart along an axis and lead wires having straight parts projecting in opposite directions from the ends of the body, said lead wires being fixed to inner surfaces of said respective slits with said lead wires intersecting with said element connection parts, an axis of said body being parallel with and offset from a line connecting said element connection parts to each other and each of said lead wires having a stress-absorbing part, which is a bent part formed by bending said lead wire between said straight part and said element connection part in a plane orthogonal to a direction in which said element connection part is projected, the stress-absorbing parts absorbing a force of flexing said lead wire generated when said bus bars are displaced about said housing like a seesaw.

2. The electronic element-incorporating connector of claim 1, wherein each of said lead wires has said bent part at one portion thereof and is L-shaped.

3. The electronic element-incorporating connector of claim 1, wherein said connector housing has a pair of holding strip holding said electronic element body.

4. An electronic element-incorporating connector, comprising:

a housing made of synthetic resin;

two bus bars arranged side by side and mounted in the housing by molding so that the bus bars penetrate through the housing, each of the bus bars having an element connection part projecting from an upper surface of the housing and an equipment connection part projecting from a lower surface of the housing, the element connection parts being plate-shaped and opposed to each other, and each of said element connection parts having a slit formed by cutting an end thereof; and an electronic element having a body with opposite ends spaced apart along an axis and lead wires having straight parts projecting in opposite directions from the ends of the body, said lead wires being fixed to inner surfaces of said respective slits with said lead wires intersecting with said element connection parts (31), said body being disposed in a region sandwiched between said element connection parts, and each of said lead wires having a stress-absorbing part, which is a bent part formed by bending said lead wire between said straight part and said element connection part, the stress-absorbing parts absorbing a force of flexing said lead wire generated when said bus bars are displaced about said housing like a seesaw.

5. The electronic element-incorporating connector of claim 4, wherein each of said lead wires has two bent parts and is crank-shaped, whereby an axis of said electronic element body is parallel to and offset from a direction in which said both element connection parts are arranged side by side.

6. An electronic element-incorporating connector, comprising:

a housing made of synthetic resin;

two bus bars arranged side by side and mounted in the housing by molding so that the bus bars penetrate through the housing, each of the bus bars having an element connection part projecting from an upper surface of the housing and an equipment connection part projecting from a lower surface of the housing, the element connection parts being plate-shaped and opposed to each other, and each of said element connection parts having a slit formed by cutting an end thereof;

an electronic element having a body with opposite ends spaced apart along an axis and lead wires having straight parts projecting in opposite directions from the ends of the body, said lead wires being fixed to inner surfaces of said respective slits, the axis of said body being disposed obliquely to a direction in which said element connection parts are arranged side by side in a region sandwiched between said element connection parts, and each of said lead wires having a stress-absorbing part is composed of said straight part positioned between said body and said element connection part and a bent part formed by bending said lead wire at a position where said lead wire penetrates into said slit, the stress-absorbing parts absorbing a force of flexing said lead wire generated when said bus bars are displaced about said housing like a seesaw.

* * * * *